United States Patent [19]

Stowe et al.

[11] Patent Number: 4,549,608

[45] Date of Patent: Oct. 29, 1985

[54] HYDRAULIC FRACTURING METHOD EMPLOYING SPECIAL SAND CONTROL TECHNIQUE

[75] Inventors: Lawrence R. Stowe, Plano; Malcolm K. Strubhar, Irving, both of Tex.

[73] Assignee: Mobil Oil Corporation, New York, N.Y.

[21] Appl. No.: 630,177

[22] Filed: Jul. 12, 1984

[51] Int. Cl.[4] ..... E21B 43/267

[52] U.S. Cl. ..... 166/280; 166/278; 166/281

[58] Field of Search ..... 166/280, 281, 278, 308

[56] References Cited

U.S. PATENT DOCUMENTS

| | | | |
|---|---|---|---|
| 2,774,431 | 12/1956 | Sherborne | 166/280 |
| 2,978,024 | 4/1961 | Davis | 166/280 X |
| 3,075,581 | 1/1963 | Kern | 166/280 |
| 3,155,159 | 11/1964 | McGuire, Jr. et al. | 166/281 X |
| 3,316,967 | 5/1967 | Huitt et al. | 166/281 X |
| 3,434,540 | 3/1969 | Stein | 166/250 |
| 3,708,013 | 1/1973 | Dismukes | 166/276 |
| 3,756,318 | 9/1973 | Stein et al. | 166/278 |
| 3,983,941 | 10/1976 | Fitch | 166/276 |
| 3,987,850 | 10/1976 | Fitch | 166/254 |
| 4,031,959 | 6/1977 | Henderson | 166/308 X |
| 4,143,715 | 3/1979 | Pavlich | 166/281 X |
| 4,186,802 | 2/1980 | Perlman | 166/280 |
| 4,366,071 | 12/1982 | McLaughlin et al. | 166/308 X |
| 4,378,845 | 4/1983 | Medlin et al. | 166/280 X |

OTHER PUBLICATIONS

Hower et al., "Advantage Use of Potassium Chloride Water for Fracturing Water Sensitive Formations", *Producers Monthly*, Feb. 1966, pp. 8–12.

*Primary Examiner*—George A. Suchfield
*Attorney, Agent, or Firm*—A. J. McKillop; M. G. Gilman; George W. Hager, Jr.

[57] ABSTRACT

A subsurface oil or gas reservoir is hydraulically fractured by injecting a fracturing fluid through perforations in the casing of a well penetrating into such subsurface reservoir. The fracturing fluid contains a clay stabilizing agent for stabilizing clay particles or fines along the face of the resulting formation fracture. A proppant comprising a gravel packing sand is injected into the fracture. Oil or gas is then produced from the reservoir through the fracture into the well.

7 Claims, 2 Drawing Figures

HYDRAULIC FRACTURING METHOD EMPLOYING SPECIAL SAND CONTROL TECHNIQUE

BACKGROUND OF THE INVENTION

This invention relates to a method of completing a well that penetrates a subterranean formation and, more particularly, relates to a well completion technique for controlling the production of sand from the formation.

In the completion of wells drilled into the earth, a string of casing is normally run into the well and a cement slurry is flowed into the annulus between the casing string and the wall of the well. The cement slurry is allowed to set and form a cement sheath which bonds the string of casing to the wall of the well. Perforations are provided through the casing and cement sheath adjacent the subsurface formation.

Fluids, such as oil or gas, are produced through these perforations into the well. These produced fluids may carry entrained therein sand, particularly when the subsurface formation is an unconsolidated formation. Produced sand is undesirable for many reasons. It is abrasive to components found within the well, such as tubing, pumps, and valves, and must be removed from the produced fluids at the surface. Further, the produced sand may partially or completely clog the well, substantially inhibiting production, thereby making necessary an expensive workover. In addition, the sand flowing from the subsurface formation may leave therein a cavity which may result in caving of the formation and collapse of the casing.

In order to limit sand production, various techniques have been employed for preventing formation sands from entering the production stream. One such technique, commonly termed "gravel packing", involves the forming of a gravel pack in the well adjacent the entire portion of the formation exposed to the well to form a gravel filter. In a cased perforated well, the gravel may be placed inside the casing adjacent the perforations to form an inside-the-casing gravel pack or may be placed outside the casing and adjacent the formation or may be placed both inside and outside the casing. Various such conventional gravel packing techniques are described in U.S. Pat. Nos. 3,434,540; 3,708,013; 3,756,318; and 3,983,941. Such conventional gravel packing techniques have generally been successful in controlling the flow of sand from the formation into the well.

In U.S. Pat. No. 4,378,845, there is disclosed a special hydraulic fracturing technique which incorporates the gravel packing sand into the fracturing fluid. Normal hydraulic fracturing techniques include injecting a fracturing fluid ("frac fluid") under pressure into the surrounding formation, permitting the well to remain shut in long enough to allow decomposition or "break-back" of the cross-linked gel of the fracturing fluid, and removing the fracturing fluid to thereby stimulate production from the well. Such a fracturing method is effective at placing well sorted sand in vertically oriented fractures. The preferred sand for use in the fracturing fluid is the same sand which would have been selected, as described above, for constructing a gravel pack in the subject pay zone in accordance with prior art techniques. Normally, 20–40 mesh sand will be used; however, depending upon the nature of the particular formation to be subjected to the present treatment, 40–60 or 10–20 mesh sand may be used in the fracturing fluid. The fracturing sand will be deposited around the outer surface of the borehole casing so that it covers and overlaps each borehole casing perforation. More particularly, at the fracture-borehole casing interface, the sand fill will cover and exceed the width of the casing perforations, and cover and exceed the vertical height of each perforation set. Care is also exercised to ensure that the fracturing sand deposited as the sand fill within the vertical fracture does not wash out during the flow-back and production steps. After completion of the fracturing treatment, fracture closure due to compressive earth stresses holds the fracturing sand in place.

In most reservoirs, a fracturing treatment employing 40–60 mesh gravel pack sand, as in U.S. Pat. No. 4,378,845, will prevent the migration of formation sands into the wellbore. However, in unconsolidated or loosely consolidated formations, such as a low resistivity oil or gas reservoir, clay particles or fines are also present and are attached to the formation sand grains. These clay particles or fines, sometimes called reservoir sands as distinguished from the larger diameter or coarser formation sands, are generally less than 0.1 millimeter in diameter and can comprise as much as 50% or more of the total reservoir components. Such a significant amount of clay particles or fines, being significantly smaller than the gravel packing sand, can migrate into and plug up the gravel packing sand, thereby inhibiting oil or gas production from the reservoir.

It is, therefore, an object of the present invention to provide a novel sand control method for use in producing an unconsolidated or loosely consolidated oil or gas reservoir which comprises a hydraulic fracturing method that stabilizes the clay particles or fines along the fracture face and which also creates a very fine grain gravel pack along the length of such fracture face.

SUMMARY OF THE INVENTION

A sand control method is provided for use in a borehole having an unconsolidated or loosely consolidated oil or gas reservoir which is otherwise likely to introduce substantial amounts of sand into the borehole. The borehole casing is perforated through the reservoir at preselected intervals. The reservoir is hydraulically fractured by injecting a fracturing fluid through the casing perforations containing a clay stabilizing agent for stabilizing the clay particles or fines along the resulting formation fracture for the entire length of the fracture face so that they adhere to the formation sand grains and don't migrate into the fracture during oil or gas production from the reservoir. A proppant containing a gravel packing sand is injected into the formed fracture. Oil or gas is then produced from the reservoir through the fracture.

The fracturing fluid is injected at a volume and rate to allow the stabilizing agent to penetrate the fracture face to a depth sufficient to overcome the effects of fluid velocity increases in oil or gas production flow or the movement of clay particles or fines located near the fracture face into the fracture as such production flow linearly approaches the fracture face.

A fine grain sand may also be included in the fracturing fluid which is significantly smaller than the gravel packing sand. The hydraulic fracturing pushes the fine grain sand up against the face of the fracture to produce a fine grain gravel filter for preventing the migration of clay particles or fines from the reservoir into the fracture, which can plug the gravel packing sand, which is thereafter injected into the fracture. Preferably, the fine grain sand is about 100 mesh and the gravel packing sand is about 40–60 mesh.

In a yet further aspect, a gravel pack may be added inside the casing prior to production to assure the extension of gravel packing material into the fracture since the fracture step has brought the fracture right up to the casing perforations.

DESCRIPTION OF THE PREFERRED EMBODIMENT

Figure 1:
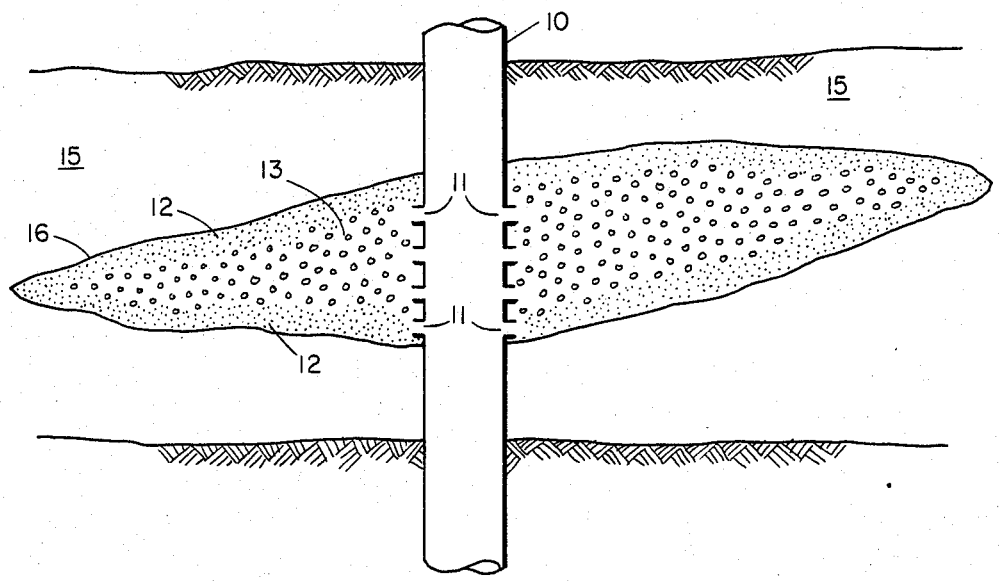
FIG. 1 is a diagrammatic view of a foreshortened, perforated well casing at a location within an unconsolidated or loosely consolidated formation, illustrating vertical perforations, vertical fractures, and fracturing sands which have been injected into the formation to create the vertical fractures in accordance with the method of the present invention.

In FIG. 1, a foreshortened borehole casing, designated generally as 10, is illustrated which is disposed within a loosely consolidated or unconsolidated formation 15. The borehole casing 10 may be a conventional perforatable borehole casing, such as, for example, a cement sheathed, metal-lined borehole casing.

The next step in the performance of the preferred embodiment method is the perforating of casing 10 to provide a plurality of perforations at preselected intervals therealong. Such perforations should, at each level, comprise two sets of perforations which are simultaneously formed on opposite sides of the borehole casing. These perforations should have diameters between $\frac{1}{4}$ and $\frac{3}{4}$ of an inch, be placed in line, and be substantially parallel to the longitudinal axis of the borehole casing.

In order to produce the desired in-line perforation, a conventional perforation gun should be properly loaded and fired simultaneously to produce all of the perforations within the formation zone to be fractured. Proper alignment of the perforations should be achieved by equally spacing an appropriate number of charges on opposite sides of a single gun. The length of the gun should be equal to the thickness of the interval to be perforated. Azimuthal orientation of the charges at firing is not critical, since the initial fracture produced through the present method will leave the wellbore in the plane of the perforations. If this orientation is different from the preferred one, the fracture can be expected to bend smoothly into the preferred orientation within a few feet from the wellbore. This bending around of the fracture should not interfere with the characteristics of the completed well.

Following casing perforation, the formation is fractured in accordance with the method of the present invention to control sand production during oil or gas production. When fracturing with the method taught in U.S. Pat. No. 4,378,845, oil or gas production inflow will be linear into the fracture as opposed to radial into the well casing. From a fluid flow standpoint, there is a certain production fluid velocity required to carry fines toward the fracture face. Those fines located a few feet away from the fracture face will be left undisturbed during production since the fluid velocity at the distance from the fracture face is not sufficient to move the fines. However, fluid velocity increases as it linearly approaches the fracture and eventually is sufficient to move fines located near the fracture face into the fracture. It is, therefore, a specific feature of the present invention to stabilize such fines near the fracture faces to make sure they adhere to the formation sand grains and don't move into the fracture as fluid velocity increases. Prior stabilization procedures have only been concerned with radial production flow into the well casing which would plug the perforations in the casing. Consequently, stabilization was only needed within a few feet around the well casing. In an unconsolidated sand formation, such fines can be 30%–50% or more of the total formation constituency, which can pose quite a sand control problem. Stabilization is, therefore, needed a sufficient distance from the fracture face along the entire fracture line so that as the fluid velocity increases toward the fracture there won't be a sand control problem.

Figure 2:
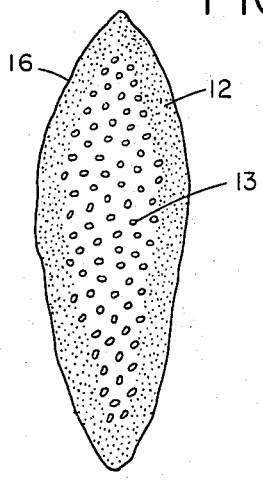
FIG. 2 is a cross-sectional end view of the reservoir fracture of FIG. 1.

A brief description of the fracturing treatment of the invention will now be set forth, following which a more detailed description of an actual field fracturing operation carrying out such a fracturing treatment will also be set forth. Intially, a fracture fluid containing an organic clay stabilizing agent is injected through the well casing perforations 10 into the formation 11, as shown in FIG. 1. Such a stabilizing agent adheres the clay particles or fines to the coarser sand grains. In the same fracturing fluid injection, or in a second injection step, a very small mesh sand, such as 100 mesh, is injected. As fracturing continues, the small mesh sand will be pushed up against the fractured formation's face 16 to form a layer 12. Thereafter, a proppant injection step fills the fracture with a larger mesh sand, preferably 40–60 mesh to form a layer 13. A cross-sectional end view of the reservoir fracture is shown in FIG. 2. It has been conventional practice to use such a 40–60 mesh sand for gravel packing. However, for low resistivity unconsolidated or loosely consolidated sands, a conventional 40–60 mesh gravel pack will not hold out the fines. The combination of a 100 mesh sand layer up against the fracture face and the 40–60 proppant sand layer makes a very fine grain gravel filter that will hold out such fines. As oil or gas production is carried out from the reservoir, the 100 mesh layer sand will be held against the formation face by the 40–60 mesh proppant layer and won't be displaced, thereby providing for such a very fine grain gravel filter at the formation face. Fluid injection with the 40–60 mesh proppant fills the fracture and a point of screen out is reached at which the proppant comes all the way up to and fills the perforations in the well casing. The fracturing treatment of the invention is now completed and oil or gas production may now be carried out with improved sand control. Prior to production, however, it might be further advantageous for sand control purposes to carry out a conventional inside the casing gravel pack step. Such a conventional gravel pack step is assured of extending the packing material right into the fracture because the fracturing step has brought the fracture right up to the well casing perforations.

Having briefly described the hydraulic fracturing method of the invention for increasing sand control, a more detailed description of an actual field operation employed for carrying out such method will now be set forth. Reference to Tables I and II will aid in the understanding of the actual field operation. Initially, as shown in step 1 in Table I, 7,500 gallons of a 2% KCl solution containing 1% by volume of a clay stabilizer, such as Western's Clay Master 3 or B. J. Hughes' Claytrol, is injected into the reservoir. For a 40-foot fracture height, about 187.5 gallons of clay stabilizing material was used per foot of formation radially from the well casing pumped at a rate of 20 barrels per minute so as to provide as wide a fracture as possible. This contrasts with conventional gravel packing techniques of using clay stabilizing agents to treat the formation outward of one to two feet from the wellbore with about 25–50 gallons per foot at a much lower pumping rate.

In step 2, 5,000 gallons of fracturing fluid was injected having a 50 lb./1,000 gal. cross-linked HPG in water containing 2% KCl, 20 lb./1,000 gal. fine particle oil soluble resin and 1 lb./gal. 100 mesh sand.

In steps 3–7, 43,500 lbs. of 40–60 mesh sand proppant is incrementally added with 11,500 gallons of fracturing fluid. During the final 500 gallons of fluid injection, the cross-linker was eliminated and the pumping rate reduced to 5 barrels per minute.

In step 8, no further proppant was added and the fracture was flushed with 1,600 gallons of 2% KCl water. In each of steps 2–8, the injection fluid contained a 1% by volume of the organic clay stabilizing agent.

The final stage of the fracturing treatment was designed to the point of screen out, leaving the perforations covered with the fracturing sand inside the well casing. At this point, injection was continued until 7,500 gallons of fluid containing 2% KCl water and organic clay stabilizing agent had been displaced into the fracture. Finally, the KCl water was displaced with a $ZnBr_2$ weighted fluid.

Following the fracturing treatment, a conventional gravel pack was placed in and immediately surrounding the well casing to hold the 40–60 mesh sand in place and the well was opened to oil or gas flow from the reservoir.

TABLE I

| | Fracturing Treatment | |
|---|---|---|
| Step No. | Fluid Vol. (Gals.) Incremental | Proppant (Lbs.) Incremental |
| 1 | 7500 | 0 |
| 2 | 5000 | 0 |
| 3 | 2500 | 2500 |
| 4 | 2500 | 5000 |
| 5 | 3000 | 12000 |
| 6 | 2000 | 12000 |
| 7 | 1500 | 12000 |
| 8 | 1600 | 0 |

Note:
Pump rate = 20 BPM and Proppant = 40/60 mesh sand.

TABLE II

| Treatment Volumes & Materials | |
|---|---|
| Step 1: | 7500 gals. Maxi-Pad containing per 1000 gals.:<br>170 lbs. KCl (2%)<br>3 gals. Clay Master 3 (clay stabilizer)<br>2 gals. Flo-Back 10 |
| Step 2: | 5000 gals. Apollo-50 containing per 1000 gals.:<br>170 lbs. KCl<br>3 gals. Clay Master 3<br>2 gals. Flo-Back 10<br>0.25 gals. Frac-Cide 2 (bacteria)<br>20 lbs. Frac Seal |
| Steps 3–7: | 11,500 gals Apollo-50 containing per 1000 gals.:<br>170 lbs. KCl<br>3 gals. Clay Master 3<br>2 gals. Flow-Back 10<br>0.25 gals. Frac-Cide 2<br>20 lbs. Frac-Seal<br>0.5 lbs. B-5 (breaker) |
| Step 8: | 1600 gals. of same fluid as steps 3–7 |

TABLE II-continued

| Treatment Volumes & Materials | |
|---|---|
| Flush step: | 7500 gals. fresh water containing per 1000 gals.:<br>170 lbs. KCl<br>3 gals. Clay Master 3<br>2 gals. Flo-Back 10<br>10 lbs. J-12 (gelling agent) |

We claim:

1. A sand control method for use in a borehole having an unconsolidated or loosely consolidated oil or gas reservoir which is otherwise likely to introduce substantial amounts of sand into the borehole, comprising:

(a) providing a borehole casing through said unconsolidated or loosely consolidated oil or gas reservoir, (b) perforating said casing at preselected intervals therealong to form at least one set of longitudinal, in-line perforations, (c) hydraulically fracturing said reservoir by injecting a fracturing fluid containing a fine grain sand and a clay stabilizing agent through said perforations at a volume and rate to allow said stabilizing agent to penetrate the fracture face along its entire length at a depth sufficient to overcome the effects of fluid velocity increases in oil or gas production flow on the movement of clay particles or fines located near the fracture face into the fracture as such production flow linearly approaches said fracture face, (d) injecting a proppant comprising a gravel packing sand into said fracture so that said gravel packing sand pushes said fine grain sand up against the face of the fractured reservoir, whereby a first layer of fine grain sand is held in place along the entire face of said fracture by a second layer of gravel packing sand also extending along the entire length of said fracture to prevent the migration of clay particles or fines from said reservoir into said fracture, and (e) producing oil or gas from said reservoir through said fracture into said borehole casing.

2. The method of claim 1 wherein said fine grain sand is no larger than 100 mesh.

3. The method of claim 2 wherein said gravel packing sand is 40–60 mesh.

4. The method of claim 1 wherein said fine grain sand is a mixture of particles, the largest being 40–60 mesh.

5. A sand control method for use in a borehole having an unconsolidated or loosely consolidated oil or gas reservoir which otherwise likely to introduce substantial amounts of sand into the borehole, comprising:

(a) providing a borehole casing through said unconsolidated or loosely consolidated oil or gas reservoir, (b) perforating said casing at preselected intervals therealong to form at least one set of longitudinal, in-line perforations, (c) hydraulically fracturing said reservoir by injecting a fracturing fluid through said perforations, (d) injecting a clay stabilizing agent into the face of the resulting reservoir fracture along the entire length of the fracture at a rate to penetrate the fracture face along its entire length to minimize the movement of clay particles or fines from the reservoir into the fracture under the influence of oil or gas fluid velocity increase as such fluid linearly approaches the fracture along its entire length during production, (e) injecting a fine grain sand no larger than about 100 mesh into said fracture and forcing said fine grain sand up against the face of the fractured reservoir to form a first filter layer along the entire length of the fracture, (f) injecting a gravel packing sand into said fracture to form a second filter layer for holding said first filter layer in place along the face of the fracture, the combination of said first filter layer of fine grain sand up against the face of the fracture and said second filter layer of gravel packing sand up against the fine grain sand provides a two-layer gravel filter that prevents both clay particles or fines and formation sands from migrating from said reservoir during oil or gas production from said reservoir, (g) reducing the rate of injection of said gravel packing sand after the propagation of the fracture has been completed and continuing such reduced rate of injection until screen out has occurred, and (h) producing oil or gas from said reservoir.

6. A sand control method for use in a borehole having an unconsolidated or loosely consolidated oil or gas reservoir which is otherwise likely to introduce substantial amounts of sand into the borehole, comprising:

(a) providing a borehole casing through said unconsolidated or loosely consolidated oil or gas reservoir, (b) perforating said casing at preselected intervals therealong to form at least one set of longitudinal, in-line perforations, (c) hydraulically fracturing said reservoir by injecting a fracturing fluid containing a clay stabilizing agent through said perforations, said clay stabilizing agent penetrates the reservoir to minimize the movement of clay particles or fines from the reservoir into the resulting fracture under the influence of oil or gas fluid flow during production, (d) injecting a proppant comprising a gravel packing sand into said fracture, (e) forming a first gravel layer up against the face of the resulting formation fracture along its entire length, (f) forming a second gravel layer up against said first gravel layer along the entire length of the face of said fracture and completely filling said fracture up to said well casing with said second gravel layer, the grain size of said first gravel layer being much finer than the grain size of said second gravel layer to prevent the plugging of said second gravel layer with clay particles or fines which would otherwise move from said reservoir into said fracture and plug up said second gravel layer under the sweeping influence of oil or gas flow from said reservoir into said fracture during production, and (g) producing said reservoir through said well casing.

7. The method of claim 6 further comprising the step of providing an inside the casing gravel pack prior to the step of producing said reservoir, such a gravel packing step assures the extension of the packing material into the fracture since the fracturing step has brought the fracture right up to the well casing perforations.

* * * * *